US005709099A

United States Patent [19]

Blades et al.

[11] Patent Number: 5,709,099

[45] Date of Patent: Jan. 20, 1998

[54] MULTI-PURPOSE RECREATIONAL FACILITY

[75] Inventors: Russell W. Blades, Carlisle; Roger E. Bacci, Richmond Hill; Brendan J. Lenko, Hamilton, all of Canada

[73] Assignee: Bassai Limited, Canada

[21] Appl. No.: 495,045

[22] Filed: Jun. 27, 1995

[30] Foreign Application Priority Data

Jun. 9, 1995 [CA] Canada ..... 2151430

[51] Int. Cl.[6] ..... A63C 19/10; F25C 3/02

[52] U.S. Cl. ..... 62/235; 4/494; 165/53

[58] Field of Search ..... 62/235; 165/48.1, 165/53, 54; 4/493, 494, 506

[56] References Cited

U.S. PATENT DOCUMENTS

| | | | |
|---|---|---|---|
| 1,918,437 | 7/1933 | Torrance | 62/235 |
| 2,628,364 | 2/1953 | Wallace et al. | 4/494 |
| 2,766,046 | 10/1956 | Skrainka | 4/494 |
| 3,797,049 | 3/1974 | De Santo | 4/506 X |
| 4,594,859 | 6/1986 | Ohashi | 62/235 |

*Primary Examiner*—Harry B. Tanner

*Attorney, Agent, or Firm*—Steven F. Caserza; Flehr Hohbach Test Albritton & Herbert LLP

[57] ABSTRACT

An ice rink and an aquatic facility are combined into a single multi-purpose recreational facility. A new ice rink can be created or an existing ice rink can be modified. This multi-purpose recreational facility also permits the shared design, use, infrastructure and cost. The multi-purpose facility has modular components that can be added within the rink structure to create lazy rivers, islands, lap pools, bridges, decks, splash areas, water parks, slides and play features. A rink base may be adapted to support both a layer of ice and water. Furthermore, a membrane can be incorporated into the floor and rink boards to create an impervious tank for the water. The rink dasher board or wall system and gates can be modified to create a sealed enclosure which can withstand the force from the static and dynamic loads (water, people, equipment, decking, etc.). The wall may also be adapted to provide a means and support for the pool water recirculation system. Further, the refrigeration piping and plant can be modified to provide both cooling and heating for the pool water or rink ice.

28 Claims, 9 Drawing Sheets

MULTI-PURPOSE RECREATIONAL FACILITY

FIELD OF THE INVENTION

This invention relates to a multi-purpose recreational facility, and in particular a single facility which combines the features of both an ice rink and an aquatic facility. The invention includes methods for temporarily or permanently converting ice rinks to aquatic facilities, and vice versa.

BACKGROUND OF THE INVENTION

The need for aquatic recreation has increased over the last 30 years. Experts are seeing a growing trend towards leisure swimming and aqua fitness, rather than laps and diving which requires traditional rectangular pools, with a large deep end. Unfortunately, existing pools are not designed or capable of meeting these new uses as well as conventional swimming activities. In addition, communities need to provide ice rinks to meet the present and future needs of the various ice user groups (hockey, figure skating, speed skating, leisure skating, etc.).

The capital cost of traditional pools and ice rinks is often a major stumbling block for communities. Furthermore, conventional ice rinks and pools are expensive to operate and therefore most communities or owners operate at a substantial loss, in trying to provide these recreational services.

Finally, available land for construction is often limited. There are also weather, liability and vandalism problems associated with outdoor pools. The conventional designs are limited in use and appeal and the obligation of providing recreational services for all user groups (elderly, handicapped, minorities, children, etc), places a tremendous burden on communities and private owners.

Conventionally designed single purpose facilities cannot cost effectively meet the present or changing needs of the entire community. Therefore, there exists a need for alternative designs of ice rinks and pools.

A single, multi-purpose facility that can function as both an ice rink and a pool, depending upon the needs at a particular time of the facility operator, is therefore an ideal solution to many of the economic problems associated with single function facilities.

It is known that the greatest demand for skating and hockey is usually during the winter, spring and fall. Therefore, ice rinks typically have little or no activity during the warmer months. By comparison, the greatest demand for aquatic activities is typically during the summer season (even though most indoor pools operate year round). Therefore, a year round multi-purpose facility that can provide both of these activities, is desirable from both a programming and an operating standpoint.

In certain jurisdictions, there exist an abundance of pools and very few ice rinks. To meet the temporary, periodic demand for skating, a way of converting the indoor pool to an ice rink has already been developed. This system comprises erecting a temporary, elevated floor, rink boards and refrigeration system above the pool area. The floor and ice slab for the ice rink are supported by beams, posts, decking and scaffolding above the swimming pool structure.

However, to erect such a structure requires a large amount of time, labour, materials and money. Furthermore, much of the material used to erect the structure is single purpose, cannot be reused, and must be discarded. Also there is a significant amount of time required when the facility is being changed from an ice rink mode to an aquatic mode, and vice versa. Thus such a facility will typically be unusable for a significant period of time.

Heretofore, no attempt has been made to convert an ice rink (indoor or outdoor) to a facility which also can operate as pool or aquatic facility, utilizing compatible, reusable, interchangeable and common components and systems.

SUMMARY OF THE INVENTION

In accordance with one aspect of the present invention there is provided a multi-purpose recreational facility comprising: a base to support one of a layer of frozen fluid and a pre-selected quantity of fluid; an upstanding wall surrounding said base, and having an opening; a fluid retaining membrane extending from said wall onto said base; a door moveable between an open position whereat said door does not block said opening and a closed position whereat said door blocks said opening, and said wall, said door, said base and said membrane define a tank to retain said quantity of fluid; and a refrigeration system to freeze said layer of frozen fluid on said base.

In accordance with another aspect of the present invention there is provided a multipurpose recreational facility comprising: a base to support one of a layer of frozen fluid and a pre-selected quantity of fluid; an upstanding wall surrounding said base, said wall defining an enclosure, such that said wall and said base define a tank, said wall being adapted to retain said quantity of fluid within said tank; a waterproof seal between said base and said wall; and a heating and refrigeration system comprising a heat exchanger in thermal communication with said base, said heat exchanger operable to heat said quantity of liquid and to freeze said layer of frozen fluid on said base.

According to another aspect of the invention, there is provided a multi-purpose recreational facility comprising: an impervious base adapted to support one of a layer of ice and a pre-selected quantity of fluid; an impervious wall upstanding from and secured to said base, said wall defining an enclosure such that said wall and said base define a tank, said wall and base being adapted to retain said quantity of fluid within said tank; a first pipe system having an input end and an output end, said first pipe system located proximate said base and being in fluid communication with a refrigeration and heating system; said refrigeration and heating system comprising a second pipe system having an input end and an output end, both input and output ends being in fluid communication with the output and input ends respectively of said first pipe system, whereby said first and second pipe systems form a pipe circuit; a secondary refrigerant disposed with said pipe circuit; a heat exchanger disposed in said second pipe system for removing heat from said secondary refrigerant carried within said pipe circuit; a pump disposed in said second pipe system and being adapted to pump said secondary refrigerant through said pipe circuit; a heater disposed in said second pipe system for heating said secondary refrigerant carried within said pipe circuit; a valve means for alternating the flow of said secondary refrigerant either along a first path through said heat exchanger or along a second path through said heater; whereby when secondary refrigerant is driven along said first path, said secondary refrigerant will pass through said heat exchanger and then through said first pipe system to freeze, and maintain frozen, a layer of ice supported on said base, and when said secondary refrigerant is driven along said second path said secondary refrigerant will pass through said heater and said first pipe system to heat a quantity of fluid supported on said base and retained in said tank.

According to a further aspect of the invention, there is provided a method of converting an ice rink to a multi-purpose recreational facility, said ice rink comprising: a base adapted to support a layer of ice; a wall upstanding from and secured to said base, said wall defining an enclosure, said wall and said base defining a tank; said method comprising the following steps: increasing the load bearing capacity of said base such that base can support a quantity of water; strengthening the wall so that said tank can support a quantity of fluid in said tank; installing an impervious fluid retaining membrane to cover an upper surface of said base and an inward facing surface of said wall; sealing all openings in said wall water tight.

According to a further aspect of the invention, there is provided a multi-purpose recreational facility comprising: a base adapted to support a pre-selected quantity of fluid; a wall upstanding from and secured to said base, said wall defining an enclosure, such that said wall and said base define a tank, said wall and base being adapted to retain said quantity of liquid within said tank; at least one modular wall component having an interior cavity, said wall component having a sealable opening for permitting a ballast material to be put in and taken out of said cavity; wherein when said tank is filled with said quantity of liquid, and said cavity of said modular component is filled with said ballast material, said modular section may be received into said tank and remain in situ in said tank.

The present inventors have found it is possible to combine both an ice rink and an aquatic facility into a single multi-purpose recreational facility. A new ice rink can be created or an existing ice rink can be modified, to create a structure which permits a relatively easy and cost effective conversion from ice rink to a pool (aquatic facility), and vice versa. The period of time during which the facility can not be used during changeovers between pool and ice rink modes, will be reduced.

This multi-purpose facility is flexible enough in design to meet the changing recreational needs of the community, yet still provides the best operating conditions for whatever activity is in place. Furthermore, this multi-purpose recreational facility does not compromise quality (water, ice and environment) in order to achieve this result. Proper conditions are maintained and often improved for skating and aquatic activities.

This multi-purpose recreational facility also permits the shared design, use, infrastructure and cost for such items as heating, air conditioning, ventilation, dehumidification, building envelope, land lighting, water, electricity, sewage, storage, change rooms, washrooms, parking lot, concession area, utilities and services, showers, lobby area, mechanical/electrical rooms offices and stands. This translates into substantially reduced capital and operating costs in comparison to two stand alone conventional rink and pool complexes.

In such a recreational facility, national and international swimming events (50 m pool) may be held, without having the initial or ongoing financial burden associated with conventional designs. The present inventors have also discovered a way to easily modify the multi-purpose facility so that modular components can be added within the rink structure to create lazy rivers, islands, lap pools, bridges, decks, splash areas, water parks, slides and play features.

A rink base (concrete, sand, ground, etc.) may be adapted to support both a layer of ice and water. Furthermore, a membrane can be incorporated into the floor and rink boards to create an impervious tank for the water. The rink dasher board or wall system and gates can be modified to create a sealed enclosure which can withstand the force from the static and dynamic loads (water, people, equipment, decking, etc.). The wall may also be adapted to provide a means and support for the pool water recirculation system.

Further, the refrigeration piping and plant can be modified to provide both cooling and heating for the pool water or rink ice.

A permanent white membrane may be incorporated into the boards and floor design and with the added use of demineralized flood water (which produces clear ice), the problems and costs associated with painting the ice white would be eliminated, ice quality would be drastically improved and energy/operating costs substantially reduced. In addition, a white membrane would provide better illumination levels and greater visibility (due to its highly reflective properties), for both the pool and rink activities.

Modular wall, decking and support components can be added to the interior of the rink board enclosure to create changes in the standard open oval rink shapes (85 ft×185 ft, 85 ft×200 ft, 30 m×60 m, etc.). Using these components, the tanked rink can be modified to the owner's specifications. For example, these components could be used to create lazy rivers, islands, splash areas, decks, slides and bridges. These interlocking and compatible components can be changed or added to at any time to create new aquatic features and dimensions. The facility is not restricted to one standard design or function.

BRIEF DESCRIPTION OF THE DRAWINGS

The invention will be more clearly understood after reference to the following detailed specification read in conjunction with the drawings, describing and illustrating example embodiments of the invention.

FIG. 4(*b*) is a sectional, perspective view of a multi-purpose recreational facility in accordance with an embodiment of the invention operating as an ice rink.

FIG. 4(*c*) is another sectional, perspective view of the multi-purpose facility of FIG. 4(*b*) operating as an aquatic facility.

DETAILED DESCRIPTION OF PREFERRED EMBODIMENTS

Figure 1:
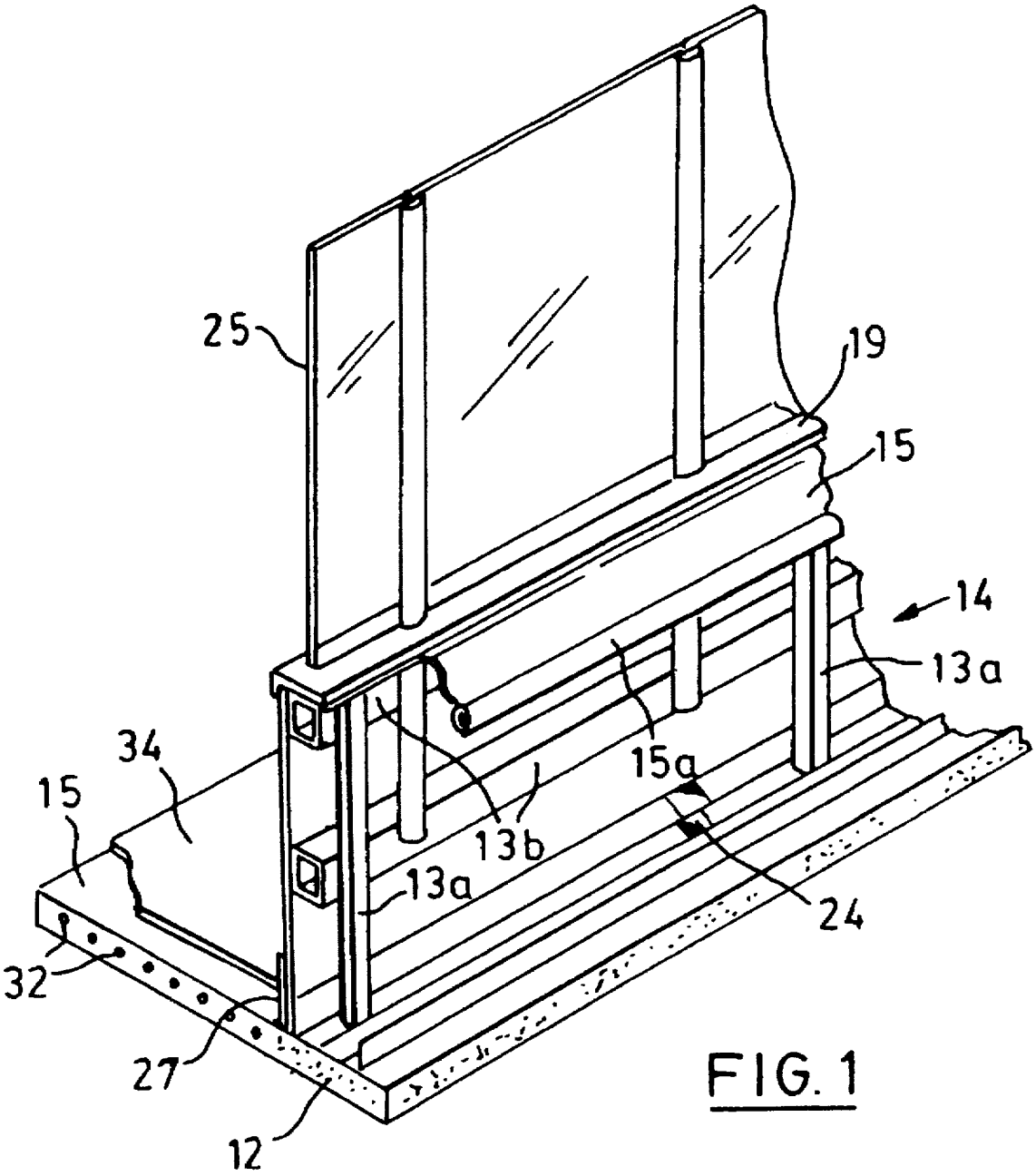
FIG. 1 is a perspective view of part of a multi-purpose recreational facility made in accordance with one embodiment of the invention.
Figure 1A:
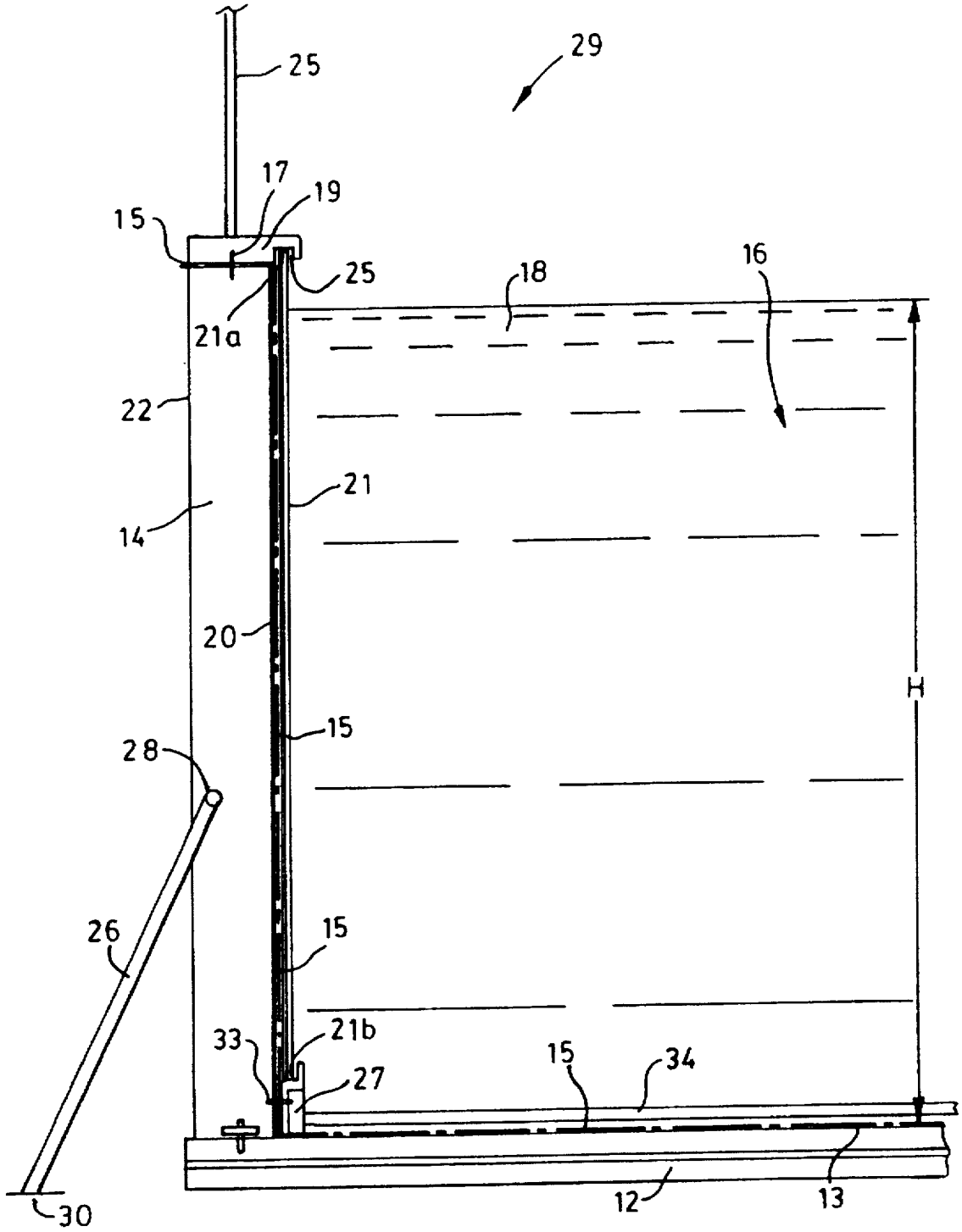
FIG. 1*a* is a side sectional view through the recreational facility of FIG. 1.
Figure 4A:
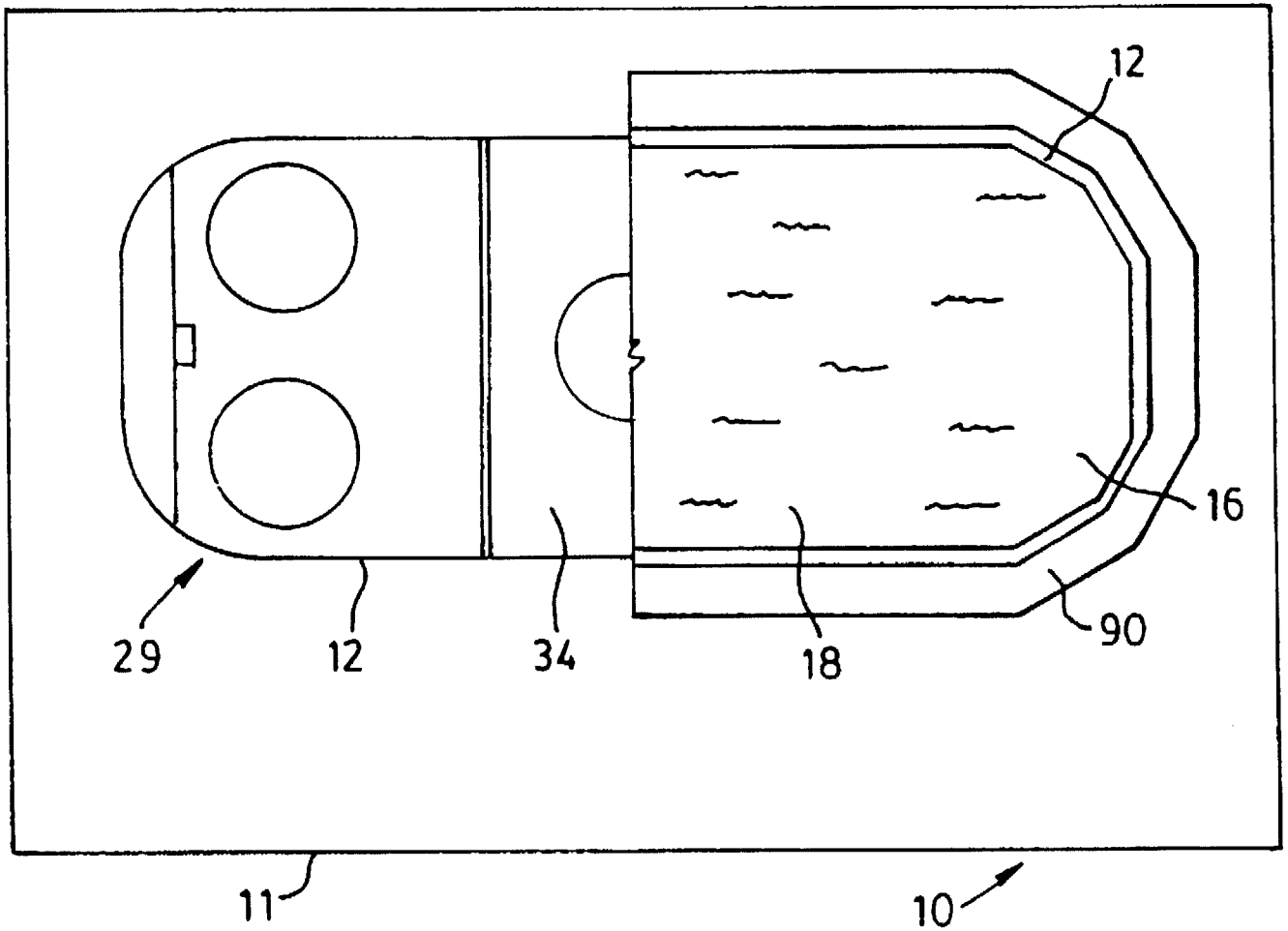
FIG. 4(*a*) is a plan view of the multi-purpose recreational facility of FIG. 1.

With reference to FIGS. 1, 1*a* and 4*a*, parts of a recreational facility generally designated 10 are illustrated. Recreational facility 10 may or may not include an enclosure such as a concrete or wood framed building. In FIG. 4*a* the outline of an enclosure 11 is shown which may be desirable in certain geographical locations, and covers and contains an ice rink/pool structure 29.

FIG. 1 shows recreational facility 10 in its ice rink mode; FIGS. 1*a* and 4*a* illustrate the features of structure 29 in both the ice rink and pool (aquatic) modes of the facility concurrently. Although facility 10 will operate only in one mode at any given time, it can easily be changed from one mode to another.

Structure 29 has a base 12 and an upstanding wall or a dasher board structure 14, which is secured to base 12. Base 12 is typically of concrete, or possibly sand. Wall 14 defines an enclosure 11 (see FIG. 4) and will in most cases be configured in a standard oval-like shape. Wall 14 together with base 12, defines a tank 16 for retaining a quantity of liquid 18. Liquid 18 will usually be water combined with water treatment additives, such as chlorine.

A longitudinal sill member 19 extends along the top of wall 14. Sill may be made from a one inch thick strip or strips of solid plastic. In the pool mode shown in FIG. 1, mounted on top of sill 19 are a plurality of transparent, tempered glass or plexiglass sheets 25, which are connected together by conventional means such as H-connectors. Sheets 25 are removable. A footing (not shown) may be required at the base of wall 14 to carry the load on the wall.

Base 12 must be able to support the weight of liquid 18 of a height H. Further, the load bearing capacity of the substrate on which base 12 rests may need to be increased if the substrate cannot carry the load of the liquid 18. For example, piles may be needed to support base 12 in some circumstances. Whether constructing a structure 29 from new, or retrofitting an existing ice rink, the base must be of such strength to support the weight of liquid 18, when the structure 29 operates in pool mode.

Wall 14 may be made of wood and/or metal construction, employing a plurality of stringers 13*a* and posts 13*b* (typically made from hollow metal tubing), covered with a material such as plywood sheets, to provide a continuous inward facing surface 20 and an outward facing surface 22. Alternatively, wall 14 may be made of concrete.

Referring to FIGS. 1 and 1*a*, wall 14 is mechanically secured to base 12 by conventional attachment means such as steel bolts and anchor plates collectively identified as 24.

Figure 3:
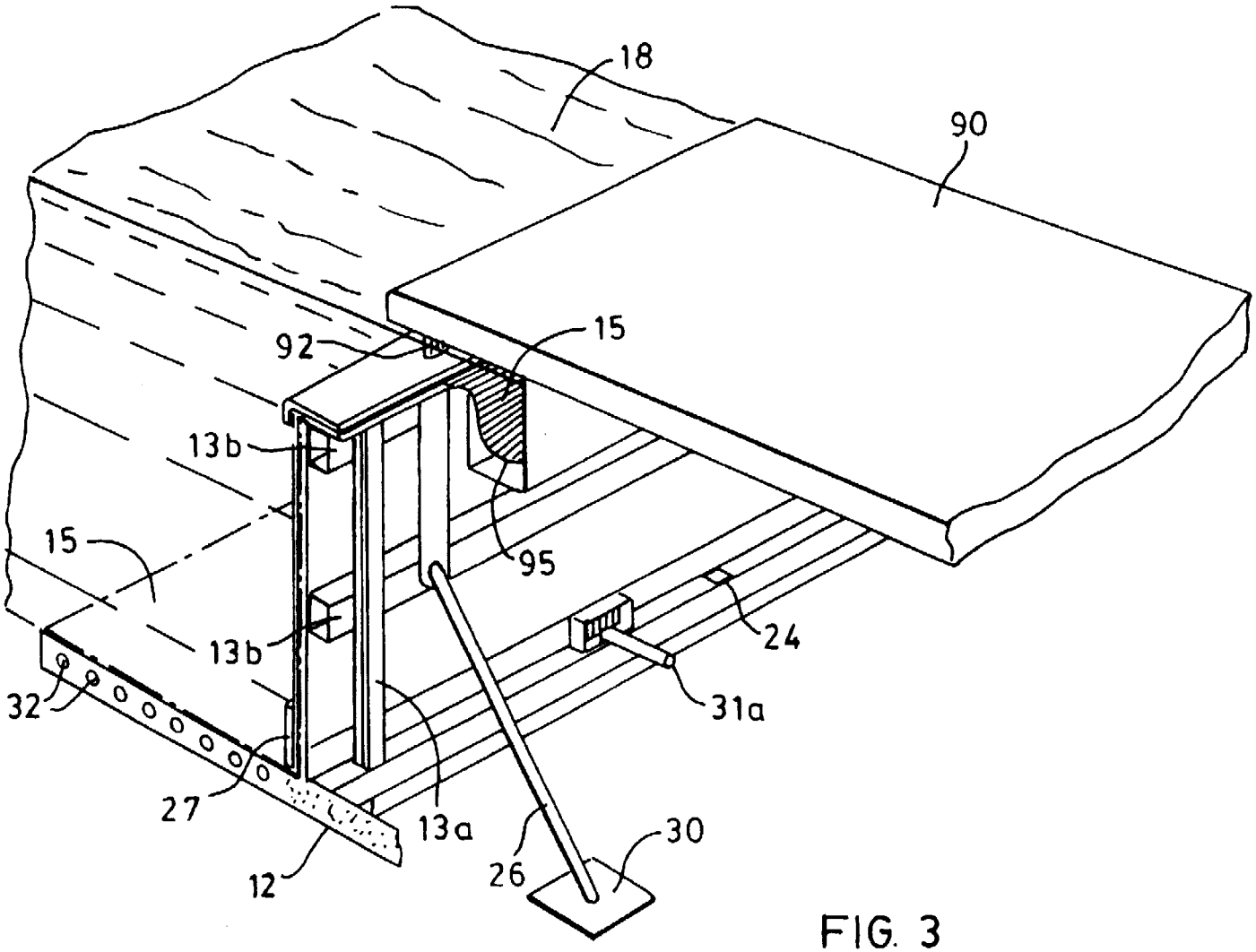
FIG. 3 is a perspective view of part of a wall of a multi-purpose recreational facility in accordance with an embodiment of the invention.

When operating in pool mode, as depicted in FIG. 3, a plurality of brace members 26, are spaced along the outer face of wall 14, and each brace is secured to wall 14 at a connection such as connection point 28. Braces 26 are connected at 30 to one or more load bearing devices such as an angle support 30*a*, so that braces 26 can withstand both compression and bending loads applied thereto by wall 14. Thus braces 26 act to support wall 14 which, when structure 29 is in the pool mode, will be heavily loaded when tank 16 is filled to height H with liquid 18. In addition to static loading on the wall 14, there may also be appreciable dynamic forces acting on wall 14 when in pool mode, resulting for example from movement of the water created by pool users. This will have to be accounted for in designing braces 26. The position of connection point 28 may be chosen so as to minimize bending on wall 14. For example, when a quantity of fluid 18 of height H is held in tank 16, applying a bracing load at a distance of H/3 from the bottom will minimize bending in the wall. Braces 26 are preferably easily disconnected from the wall support positions, so that when in the ice rink mode, they may be readily removed.

Alternate methods of reinforcing wall 14 are possible. For example, wall 14 may be constructed in a cantilever fashion, wherein wall 14 extends into the substrate and acts like a cantilever beam.

As shown in FIGS. 1 and 1*a*, a fluid retaining, impervious membrane 15 covers the upward facing surface 13 of base 12, and covers the inward facing surface 20 of wall 14. Membrane 15 is preferably a durable, 60 mm thick sheet of substantially white coloured PVC, although other materials are suitable. Membrane 15 is secured to wall 14 by a mechanical fastener 17 which passes from top sill 19, through the membrane and into wall 14. Thus membrane 15 is secured by the pinching action between wall 14 and sill 19.

As seen in FIG. 1, membrane 15 extends from between the top plate of wall 14 and sill 19 on the outside face of wall 14. The outer edge of membrane 15 is secured to a rod member 15*a* that may be made from a material such as PVC or steel and have a mechanism for attaching the rod to the outside face of the wall when the structure 29 is in ice rink mode. When it is desired to change from ice rink mode to pool mode, rod 15*a* can be released form attachment to wall 14, for use in lining a gutter trough, as described below.

It is possible to eliminate membrane 15 and instead seal the base in another manner, such as by sealing the concrete with a plurality of impervious tiles. In such a facility, a separate fluid retaining mechanism is then needed for wall 14 so that tank will retain the fluid, without leakage. Furthermore, a waterproof seal would be required between the base and the wall.

Membrane 15 may be formed in parts which can be connected together at and by a waterproof seal. A suitable such seal would be a waterproof zipper mechanism such as that used in the construction of scuba suits. Thus it may be appropriate to provide for a connection proximate where the wall and base meet, so that the portion of membrane 15 covering inner surface 20, can be removed.

Also, membrane 15 need not extend up the entire inner surface 20, or even any part of inner surface 20 of wall 14, but may be used only to cover and seal base 12. Again, in such a case, a separate fluid retaining mechanism is needed for wall 14 and a waterproof seal is required between the base and wall.

A face board is comprised of a plurality of face board sections 21 each positioned in face to face relationship with the membrane 15. Thus the portion of membrane 15 covering inner surface 20 of wall 14 is sandwiched between wall 14 and sections 21. Face board sections 21 may be formed from plywood or a similar material but preferably each has an inward facing surface made of a layer of plastic chosen for its ability to retain a white coloured appearance. Other colours may in certain circumstances be desirable. Sections 21 substantially abut each other and are connected with standard connectors such as H-clips. Thus the face board will protect that portion of the membrane covering inner surface 20 of wall 14. Each section 21 has a top edge 21*a* which is received within a longitudinally extending groove 25 in sill 19. The bottom edge 21*b* is held in place by a kick plate or kick strip 27. Membrane 15 passes between the bottom of kick plate 27 and the upper surface of base 12. Face board sections may be made readily removable, for example by providing for a kick plate 27 which can be easily removed.

Mechanical fasteners 33 pass from kick plate 27 through membrane 15 into wall 14 and are provided with gaskets to provide a waterproof seal where they pass through membrane 15. In some circumstances a kick plate may not be needed and mechanical fasteners 33 may also not need to be employed.

Figure 2:
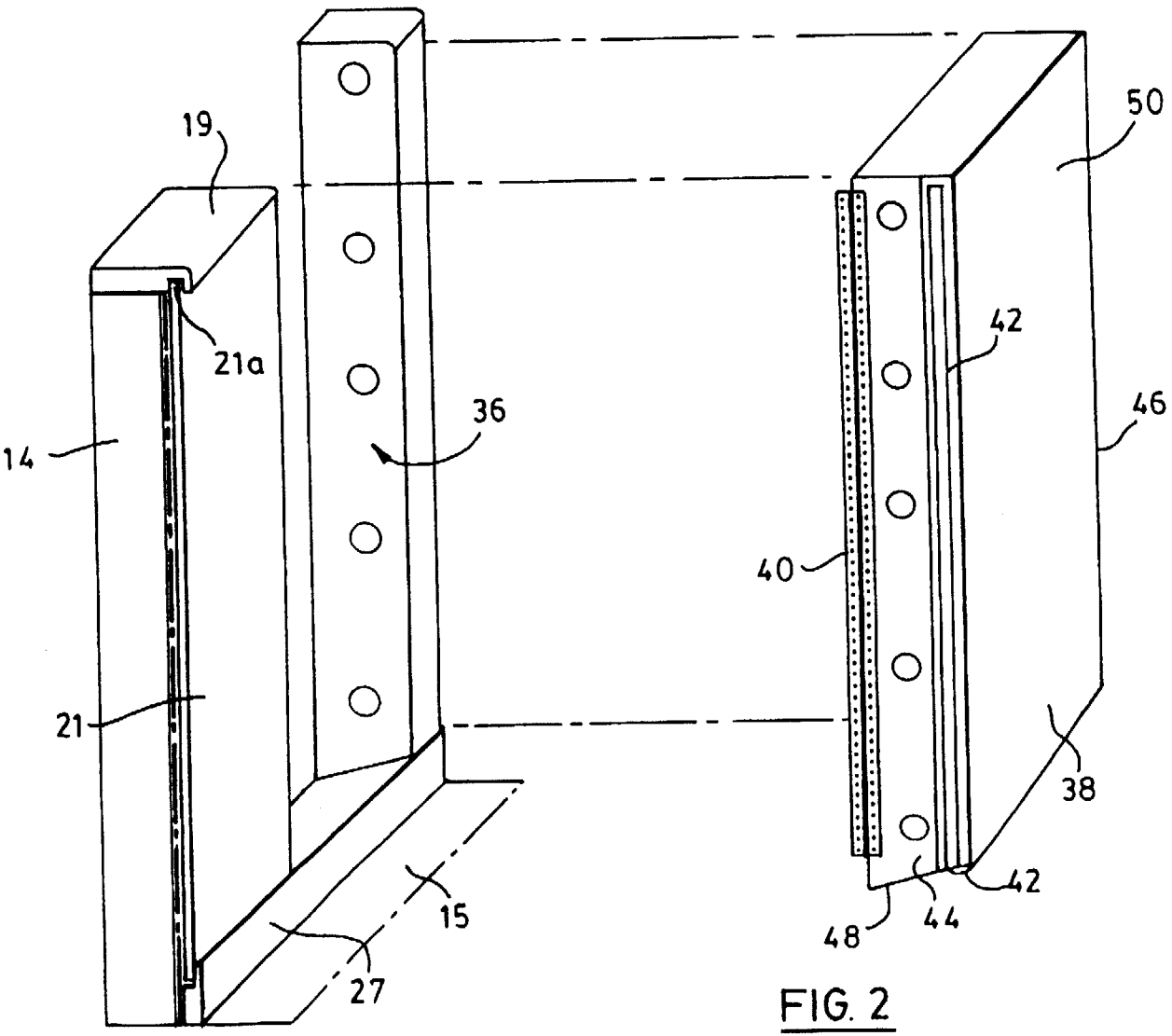
FIG. 2 is a perspective view of another part of the multi-purpose facility of FIG. 1.

Wall 14, although defining an enclosure 11, is not uninterrupted. An example of such a discontinuity is shown in FIG. 2, where an opening 36 is shown. Typically in such a facility there will be more than one such opening. A door 38, shown exploded away from opening 36 is adapted to block opening 36. A hinge 40 may be provided on door 38, to permit opening of door 36 outwardly of the tank, from a blocking relationship with the opening, to an unblocked relationship therewith. A door 38 may replace a standard ice rink door, when tank 16 is to be filled with liquid.

However, a mechanism is needed to secure the door in the blocked position when the facility is in pool mode and tank 16 is filled with liquid 18. The wall 14 at opening 36, and door 38 may be provided with bolts, to bolt the door to the wall when the tank is to be filled. Alternatively, when desiring to fill tank 16 with fluid 18, a door may be permanently welded in place.

Door 38 is typically formed of a steel and/or wood construction of posts and stringers with outer layers of plywood, in a manner similar to the rest of wall 10. The surface 50 will be finished to match the face boards. Door 38 has a seal 42 consisting of a continuous neoprene gasket located at the front peripheral edges of side faces 44,46 and bottom face 48. Thus when door 38 is positioned in opening 36 a waterproof seal is provided between the door and wall 14. Inward facing surface 50 of door 38 is impervious. The imperviousness may be effected by providing a PVC membrane layer beneath the layer of material of which surface 50 is a part.

It is also possible to provide for a waterproof connection of the zipper type referred to above, to connect the membrane 15 to a corresponding section of PVC material formed in the door, thus in effect providing for a continuous PVC membrane.

Liquid can be added to or drained from tank 16 by a variety of standard methods. The tank may be provided with a sealed drain pipe to remove liquid. Alternatively, a pump may be employed to remove the liquid.

Preferably, disposed within base 12, are a plurality of spaced, interconnected pipes 32, which are arranged in parallel longitudinal relation to each other. Pipes 32 are made from PVC or another material suitable for carrying both a heated and cooled secondary refrigerant such as brine or glycol. When a cooled secondary refrigerant is passed through pipes 32, a layer of ice 34 may be formed and maintained on the upper surface of membrane 15.

FIG. 4*a* shows for contrast, in a single illustration, recreational facility 10 in both pool mode and ice rink mode. However, as explained previously, the facility will only operate in one mode at any given time.

Figure 4C:
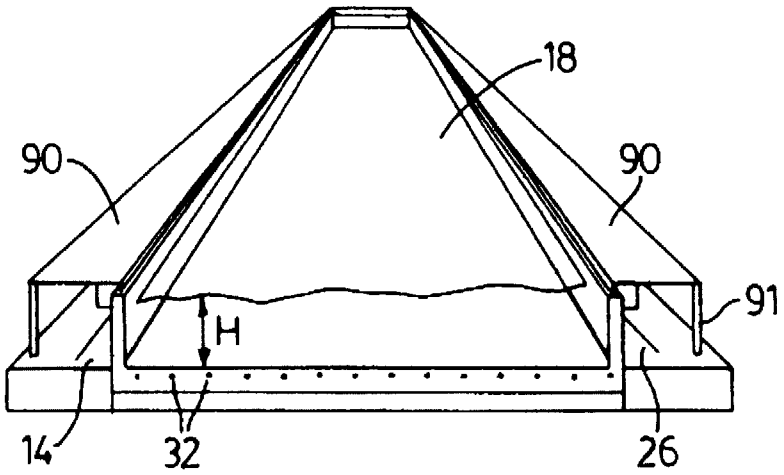
Figure 4B:
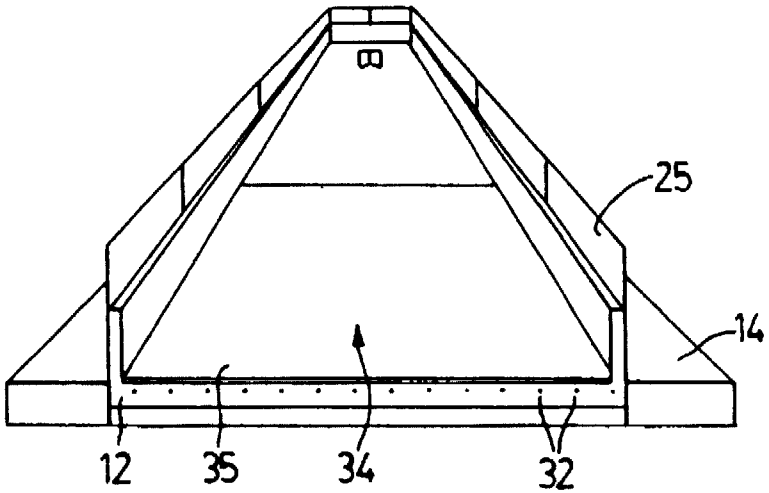

Referring to FIG. 4*b*, the ice rink mode of FIG. 1 is shown in a sectional perspective view.

In FIGS. 3 and 4*c*, the facility 10 is shown in its pool mode wherein the transparent sheets 25 mounted on top sills 19 have been removed. In their place, a pool decking 90 has been mounted above upper sill 19 of wall 14 and is partly supported on wall 14. Pool decking 90 spans the gap between wall 14 and a supporting wall 91 is erected at a distance from wall 14. Decking 90 circumscribes the entire wall 14 to permit people to more readily access the tank 16.

A series of deck supports 92 provide for a gap between deck 90 and upper sill 19. The gap permits liquid spillage flowing out of tank 16 to be directed to a gutter or trough 95. Gutter 95 will carry spillage away either to be disposal or to be filtered and recycled back into tank 16. As illustrated in FIG. 3, membrane 15 extends continuously from between the top plate of wall 14 and sill 19 and extends into the trough 95 to provide an water proof lining therefore. The rod member 15*a* around which the outer edge of membrane 15 is secured, may be attached to an upper edge of the trough 95, or even to the underside of decking 90, for example by screws though rod 15*a* into decking 90. As gutter trough 95 is thereby imperviously with the membrane, it need not necessarily be made from a completely impervious material and be completely water tight, itself.

Gutter trough 95 may be integrally formed with decking 90 or mechanically attached thereto. Alternatively, gutter 95 may be positioned with a flange which extend underneath membrane 15, between top sill 19 and the top plate of wall 14. When decking 90 is in place, the load thereof may be sufficient to secure both the outer portion of membrane 15 and gutter 95 in position.

A filtered water return pipe 31*a* may be introduced into and pass through wall 14 to provide for water filtration of liquid 18 held in tank 16. Of course a water tight connection is required where the pipe passes through membrane 15. The pipe is connected to a standard water filtration system used for a swimming pool.

From the foregoing it will be readily appreciated that the change from ice rink mode to pool mode, does not require a great degree of structural changes. Transparent panels 25 are replaced by decking 90 supported by support wall 91 and wall 14. Braces 26 are erected to provide support for wall 14. All openings 36 are sealed with doors of the type 38 or the like. The layer of ice is replaced by liquid to a height H in tank 16, by a conventional pumping device (not shown). The membrane 15 remains in place in tank 16, the outer edge is positioned as a liner in a trough 95. Some of the changes are readily apparent by comparing FIGS. 4(*b*) and 4(*c*). To change back to ice rink mode, the foregoing changes are carried out in reverse and again membrane 15 remains in place.

Unlike other recreational facilities, facility 10 has an integrated system which serves both to heat the water or liquid when in pool mode, and to create and maintain a layer of ice on the base when in rink mode. An existing ice rinks refrigeration system can readily be altered to integrate therewith a heating system, utilizing common elements.

Figure 5:
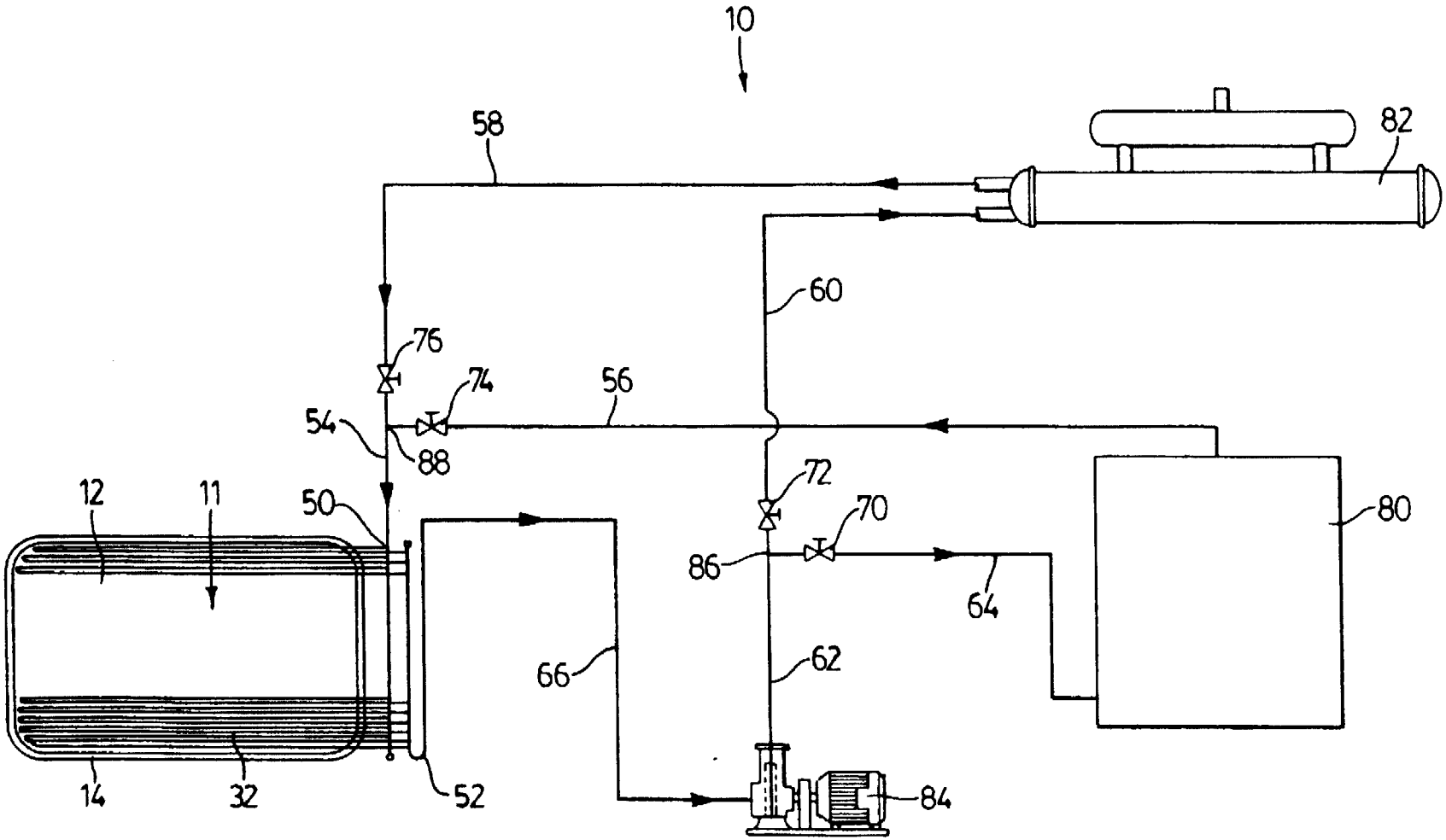
FIG. 5 is a schematic drawing of the heating and refrigeration system for a multi-purpose recreational facility in accordance with an embodiment of the invention.

FIG. 5 is a schematic layout of an integrated heating and refrigeration system for recreational facility 10. Pipes 32 are interconnected and have a common inlet 50 and common outlet 52. A pipe 66 is connected at one end to outlet 52, and at the other end to the intake of a pump 84. Pump 84 has an outlet connected to one end of a pipe 62. The other end of pipe 62 joins with pipe 64 and pipe 60 at a T-junction 86. A valve 70 is disposed in pipe 64 and a valve 72 is disposed in pipe 72. One end of pipe 64 is connected to T-junction 86, the other end to an input of a heater 80. Heater 80 is adapted to be able to heat a secondary refrigerant and may be any conventional type of heater such as a boiler, solar, etc. The output of heater 80 is connected to one end of pipe 56. The other end of pipe 56 forms a T-junction with an end of a pipe 58 and an end of pipe 54.

Pipe 60 has one end connected to T-junction 86, the other end of which is connected to the input of a heat exchanger 82. Heat exchanger 82 is of conventional type and would employ a primary refrigerant such as ammonia, to cool the secondary refrigerant. The output of the heat exchanger 82 is connected to one end of pipe 58, the other end of pipe 58 is connected to the T-junction 88. A valve 76 is disposed in pipe 58 and a valve 74 is disposed in pipe 56. Finally, one end of pipe 54 is connected to T-junction 88, the other end is connected to the input 50.

Pipes 32, 66, 62, 64, 60, 58 and 54, which may be 1 ½ inch PVC pipes, together form a closed circuit and permit the flow of a secondary refrigerant such as brine or glycol therethrough. Pump 84 drives the secondary refrigerant in one of the paths shown in FIG. 5 by the arrows. The particular path of the secondary refrigerant is determined by the valves which are open and which are closed.

When it is desired to operate the facility 10 as an ice rink (i.e. in ice rink mode), any large quantity of fluid 18 in tank 16 is drained. A layer of fluid, typically water, is placed on the upper surface of membrane 15. Valves 74 and 70 are closed, valves 76 and 72 are opened. When the heat exchanger 82 is engaged and pump 84 activated, the secondary refrigerant in the pipes will be circulated through the heat exchanger, cooled, and passed through pipes 32 in base 12. This will cool and freeze the layer of fluid to form a layer of ice 34. Due to the white colour of the membrane, the ice will appear white in colour.

When it is desired to convert the facility to an aquatic facility (i.e. pool mode), the heat exchanger is disengaged and valves 72 and 76 closed. Valves 70 and 74 are opened and pump 84 is activated. The heater is engaged with the result that the secondary refrigerant is driven through the heater 80 where it is heated, and then circulated through pipes 32.

The heated secondary refrigerant will thaw the layer of ice, and that liquid can be drained. The warming of the base will also have the effect of thawing the adjacent substrate. The result is that the base will not be cold to the touch, and will be suitable for contact with a person's skin.

The tank 16 is filled with fluid to height H, and the heated base will heat the fluid 18 in tank 16.

An existing ice rink may be converted to such a multi-purpose facility by (1) ensuring the base and substrate can carry the load and if necessary increasing the load bearing capacity; (2) providing the necessary wall reinforcement; (3) installing an impervious fluid retaining membrane; (4) providing a heating system; (5) providing necessary sealing of openings in the enclosure.

Figure 6A:
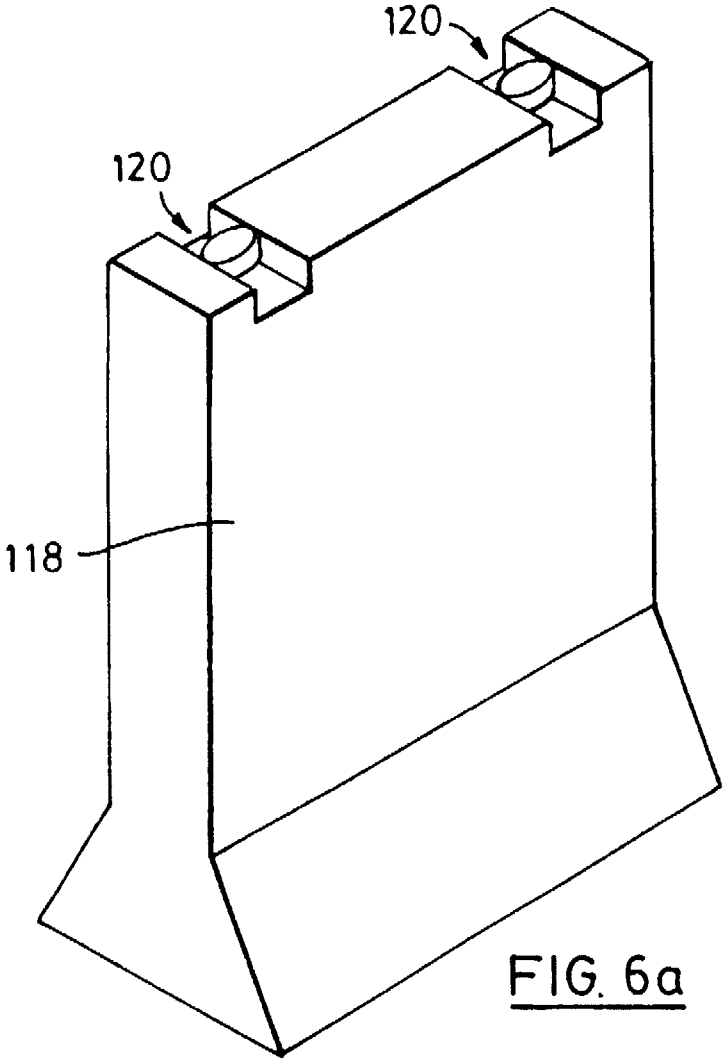
FIG. 6*a* is a more detailed perspective view of part of the modular wall section of FIG. 6.
Figure 6:
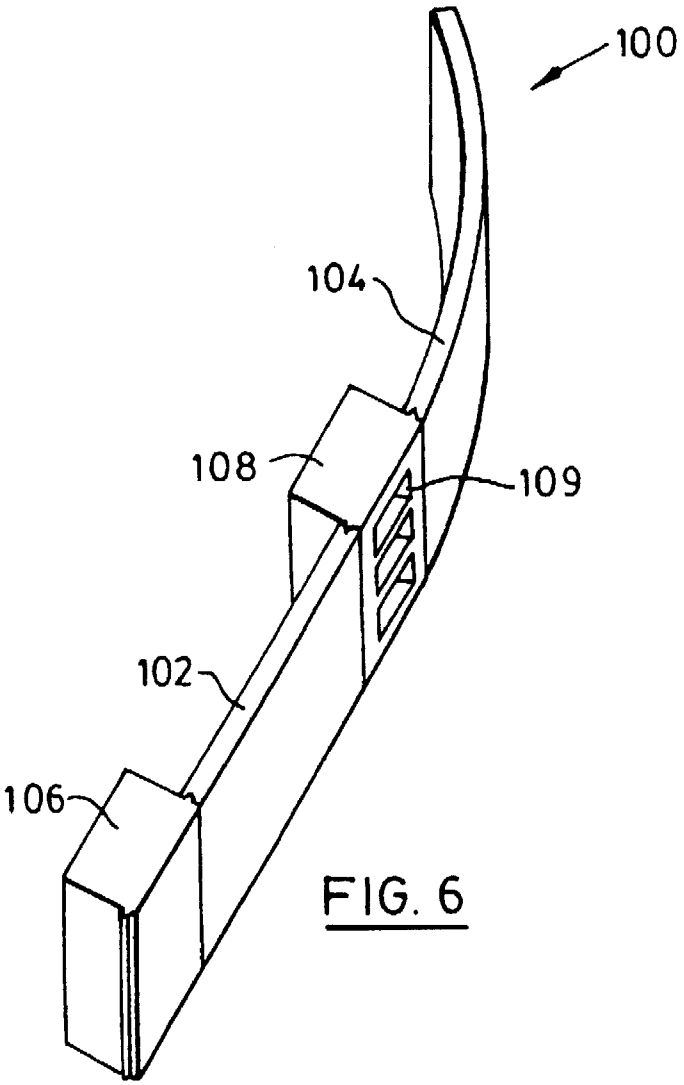
FIG. 6 is a perspective view from above of part of a modular wall section of the multi-purpose recreational facility of FIG. 1.

With reference to FIGS. 6 and 6*a*, a wall portion 100 of a modular drop-in wall section for the facility 10 is shown. Wall portion 100 comprises a straight or planar wall section 102 which is connected to a pair of support columns 106 and 108. Also extending from support column 108 is a curved wall section 104. Wall sections 102 and 104 are releasably connected to the support columns by a key and key-way slot system (not shown).

Figure 7:
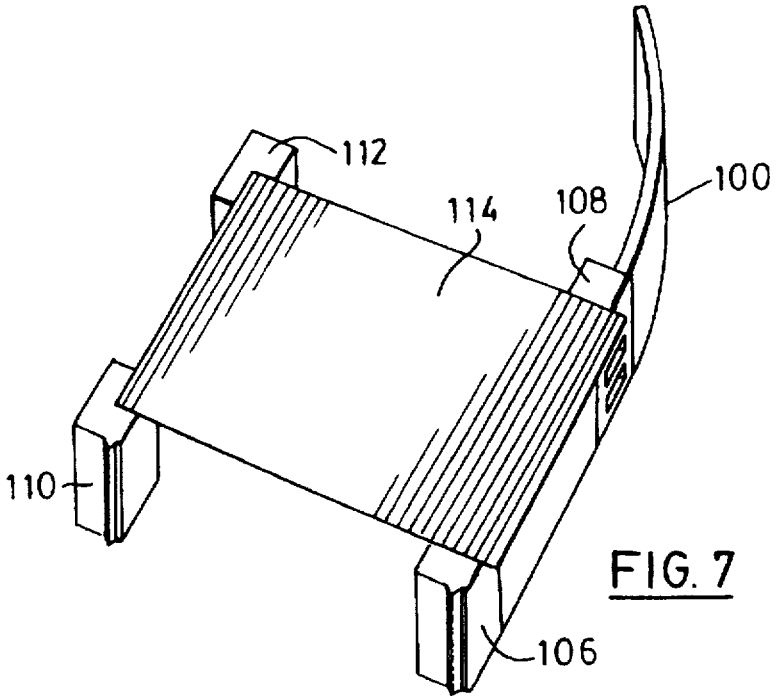
FIG. 7 is a perspective view of the part of the modular wall section of FIG. 6 shown in combination with other modular components, in accordance with an embodiment of the invention.

As shown in FIG. 7 modular wall section 100 is combined with a pair of drop-in support columns 110 and 112 to support a deck section 114. The wall section 100 and the support columns are ideally all made from a material such as fiberglass reinforced plastic ("FRP"), a plastic stainless steel, galvanized aluminum, or a lightweight concrete, which are resistant to chlorine degradation and also resistant to ultra-violet radiation. The wall section 100 and the support columns are positioned within the boundaries of the facility 10 when it is in its pool mode and filled with water.

The modular sections are utilized when the structure 29 is in pool mode. To make the modular sections easier to handle for placement into and movement out of the structure 29, wall sections and support columns may be formed of a hollow rigid material such as described above (FRP, etc.). The hollow modular components of the wall section as shown in FIG. 6*a* can each be placed in position within tank 16 as desired, and then filled with a ballast material such as sand gravel. Water may also be used in a ballast, particularly when the ballast fills the support columns and/or wall sections, to a height above height H of the water in tank 16. The ballast material must be sufficiently dense to ensure that the modular components do not float, and preferably will be dense enough to ensure that a reasonably large frictional force is developed, to maintain stability of the modular components both vertically and horizontally when in use.

FIG. 6*a* shows a modular wall section 118 which has removable caps 120 which permits a suitable ballast material with sufficient fluidity to be pumped into and out of the modular section 118.

Column 108 may be provided with apertures 109 which are formed as stairway treads to permit a person to get out of the water and onto decking 114.

In use in tank 16, filled with liquid, each of the modular components will have liquid on both sides thereof. Thus the static horizontal loading on each side of the components will be equal. With respect to any dynamic forces acting on a component, although unbalanced, it will not typically be of a magnitude to overcome the frictional resistance of the bottom of the component against the base. Moreover, the modular components may be arranged such that they are interconnected with outer wall 14, to provide the necessary degree of horizontal resistance.

Figure 8:
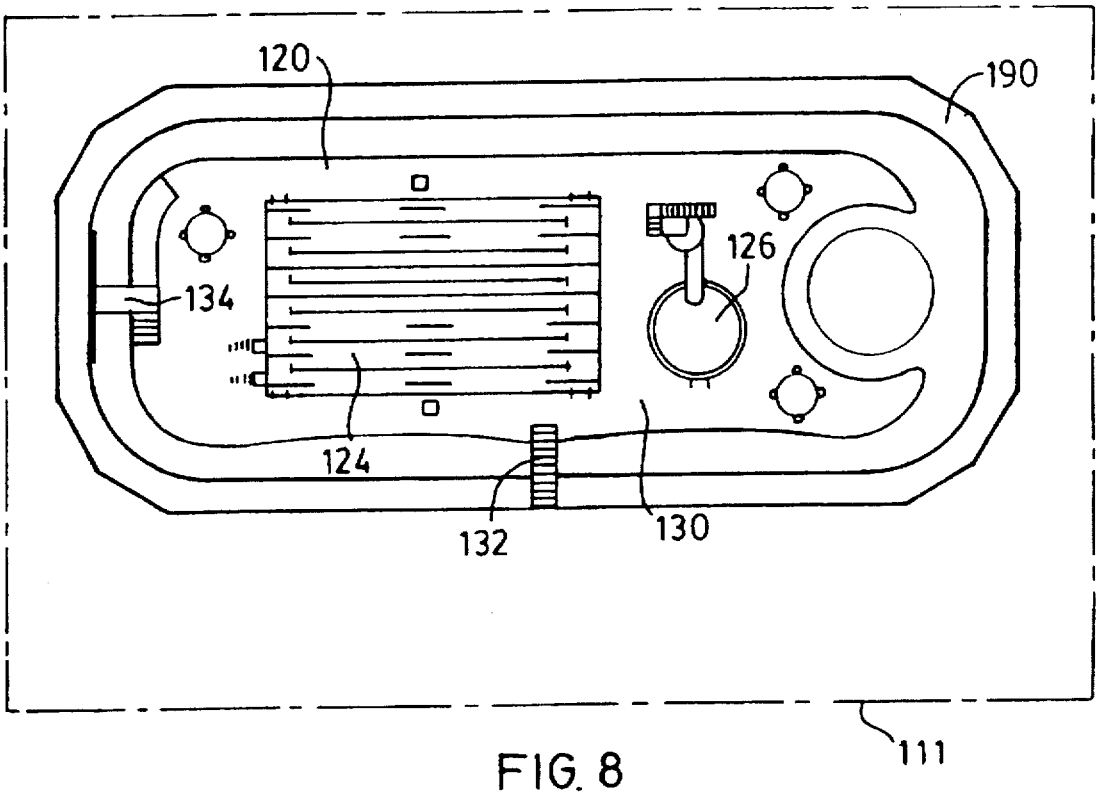
FIG. 8 is a plan view of a recreational facility constructed in accordance with an embodiment of the invention.

The use of modular components provides great flexibility in creating a facility 10, which in pool mode configuration of structure 19, may have configurations only limited by the availability of the modular component's on hand, and the creativity of the designers. As is shown in FIG. 8, within the confines of a standard ice rink configuration, by use of combinations of modular components such as those described above in addition to liberal use of decking, various aquatic features may be provided such as a circumscribing lazy river 120 and a 25 m swimming pool 124, a water slide 126 all interconnected by decking 130. Outer decking 190 is interconnected to decking 130 by bridges 132 and 134. Decking 130 is supported appropriately by support columns, such as those described above. The inner pool structure is enclosed by a conventional building 111.

It will be appreciated that many variations from the foregoing description of preferred embodiments are possible, and are contemplated to be within the scope of the invention as hereinafter claimed.

We claim:

1. A multi-purpose recreation facility comprising:

a base to support one of a layer of frozen fluid and a pre-selected quantity of fluid;

an upstanding wall surrounding said base, and having an opening;

a fluid retaining membrane extending from said wall onto said base;

a door moveable between an open position whereat said door does not block said opening and a closed position whereat said door blocks said opening, and said wall, said door, said base and said membrane define a tank to retain said quantity of fluid; and a refrigeration system to freeze said layer of frozen fluid on said base.

2. A facility as claimed in claim 1 whereto said door comprises a seal extending along an edge of said door to provide a fluid seal between said door and said wall when said door is in said closed position.

3. A facility as claimed in claim 2 wherein said seal comprises a neoprene gasket.

4. A facility as claimed in claim 1 further comprising a face board secured to said wall, so that a portion of said membrane covering said wall is between said wall and said face board.

5. A facility as claimed in claim 4 wherein said face board is comprised of a plurality of face board sections, each of said plurality of face board sections being removably secured to said wall.

6. A facility as claimed in claim 1 further comprising a heating system to heat said quantity of fluid when said fluid is retained in said tank.

7. A facility as claimed in claim 6 wherein said refrigeration system comprises:

a piping system located proximate said base having an inlet and an outlet;

a pump to drive a secondary refrigerant through said piping system; and a heat exchanger adapted to remove heat from said secondary refrigerant prior to it being driven by said pump through said piping system.

8. A facility as claimed in claim 7 wherein said heat exchanger may be disengaged and said heating system comprises a heater adapted to heat said secondary refrigerant prior to it being driven through said piping system, whereby when said heat exchanger is disengaged, said heated secondary refrigerant passes through said pipe system to heat said base and said quantity of fluid.

9. A facility as claimed in claim 8 wherein said pipe system is disposed within said base.

10. A facility as claimed in claim 1, further comprising a decking mountable generally horizontally on said wall and extending outwardly from said tank, said decking mountable in spaced relation to the top of said wall to provide a gap between the top of said wall and said decking.

11. A facility as claimed in claim 10, further comprising a trough positioned proximate said gap for receiving liquid spillage passing through said gap.

12. A facility as claimed in claim 11 wherein said membrane extends into said trough to provide an impervious lining for said trough.

13. A facility as claimed in claim 10 wherein said trough is integrally formed with said decking.

14. A multi-purpose recreational facility comprising:

a base to support one of a layer of frozen fluid and a pre-selected quantity of fluid;

an upstanding wall surrounding said base, said wall defining an enclosure, such that said wall and said base define a tank, said wall being adapted to retain said quantity of fluid within said tank;

a waterproof seal between said base and said wall; and a heating and refrigeration system comprising a heat exchanger in thermal communication with said base, said heat exchanger operable to heat said quantity of liquid and to freeze said layer of frozen fluid on said base.

15. A facility as claimed in claim 14 wherein said wall has an opening, and further comprising a fluid retaining door, said door being movable between a first closed position wherein said door is in blocking relation to said opening and a second open position wherein said door is in a non-blocking relation to said opening, whereby when said door is in said closed position, said quantity of fluid may be retained in said tank.

16. A facility as claimed in claim 15 wherein said door has a peripheral edge and a second fluid seal positioned proximate said peripheral edge to provide a waterproof seal between said wall and said door.

17. A facility as claimed in claim 14 wherein said heat exchanger comprises a piping system located proximate said base having an inlet and an outlet; said heating and refrigeration system comprises a pump to drive a secondary refrigerant through said piping system; and a second heat exchanger adapted to remove heat from secondary refrigerant prior to it being driven by said pump through said piping system.

18. A facility as claimed in claim 17 wherein said second heat exchanger may be disengaged and said heating and refrigeration system further comprises a heater adapted to heat said secondary refrigerant prior to it being driven through said piping system, whereby when said second heat exchanger is disengaged, said heated secondary refrigerant passes through said pipe system to heat said base and said quantity of fluid.

19. A facility as claimed in claim 14, further comprising a decking mountable generally horizontally on said wall and extending outwardly from said tank, said decking mountable in spaced relation to the top of said wall to provide a gap between the top of said wall and said decking.

20. A facility as claimed in claim 19, further comprising a trough positioned proximate said gap for receiving liquid spillage passing through said gap.

21. A facility as claimed in claim 20 wherein said membrane extends into said trough to provide an impervious lining for said trough.

22. A facility as claimed in claim 21 wherein said trough is integrally formed with said decking.

23. A multi-purpose recreational facility comprising:

an impervious base adapted to support one of a layer of ice and a pre-selected quantity of fluid;

an impervious wall upstanding from and secured to said base, said wall defining an enclosure such that said wall and said base define a tank, said wall and base being adapted to retain said quantity of fluid within said tank;

a first pipe system having an input end and an output end, said first pipe system located proximate said base and being in fluid communication with a refrigeration and heating system, said refrigeration and heating system comprising a second pipe system having an input end and an output end, both input and output ends being in fluid communication with the output and input ends respectively of said first pipe system, whereby said first and second pipe systems form a pipe circuit;

a secondary refrigerant disposed within said pipe circuit;

a heat exchanger disposed in said second pipe system for removing heat from said secondary refrigerant carried within said pipe circuit;

a pump disposed in said second pipe system and being adapted to pump said secondary refrigerant through said pipe circuit;

a heater disposed in said second pipe system for heating said secondary refrigerant carried within said pipe circuit; and a valve means for alternating the flow of said secondary refrigerant either along a first path through said heat exchanger or along a second path through said heater;

whereby when secondary refrigerant is driven along said first path, said secondary refrigerant will pass through said heat exchanger and then through said first pipe system to freeze, and maintain frozen, a layer of ice supported on said base, and when said secondary refrigerant is driven along said second path said secondary refrigerant will pass through said heater and said first pipe system to heat a quantity of fluid supported on said base and retained in said tank.

24. A multi-purpose recreational facility as claimed in claim 23 wherein said first pipe system is disposed in said base.

25. A multi-purpose recreational facility as claimed in claim 23 whereby when said secondary refrigerant is driven along said second path and through said heater, said secondary refrigerant will melt any ice supported on said base.

26. A method of converting an ice rink to a multi-purpose recreational facility, said ice rink comprising:

a base adapted to support a layer of ice;

a wall upstanding from and secured to said base, said wall defining an enclosure, said wall and said base defining a tank; said method comprising the following steps:

a. increasing the load bearing capacity of said base such that base can support a quantity of water;

b. strengthening the wall so that said tank can support a quantity of fluid in said tank;

c. installing an impervious fluid retaining membrane to cover an upper surface of said base and an inward facing surface of said wall; and d. sealing all openings in said wall water tight.

27. A method as claimed in claim 26 further comprising installing a heating system to heat said quantity of fluid when retained in said tank.

28. A multi-purpose recreational facility comprising:

a base adapted to support a preselected quantity of fluid;

a wall upstanding from and secured to said base, said wall defining an enclosure, such that said wall and said base define a tank, said wall and base being adapted to retain said quantity of liquid within said tank; and at least one modular wall component having an interior cavity, said wall component having a sealable opening for permitting a ballast material to be put in and taken out of said cavity;

wherein when said tank is filled with said quantity of liquid, and said cavity of said modular component is filled with said ballast material, said modular section may be received into said tank and remain in situ in said tank.

* * * * *